US007156001B2

(12) United States Patent
Cluthe

(10) Patent No.: US 7,156,001 B2
(45) Date of Patent: Jan. 2, 2007

(54) ADJUSTABLE WRENCH

(75) Inventor: Gary Paul Cluthe, Waterloo (CA)

(73) Assignee: Duron Plastics Limited, Waterloo (CA)

( * ) Notice: Subject to any disclaimer, the term of this patent is extended or adjusted under 35 U.S.C. 154(b) by 120 days.

(21) Appl. No.: 11/075,800

(22) Filed: Mar. 10, 2005

(65) Prior Publication Data

US 2005/0199105 A1 Sep. 15, 2005

Related U.S. Application Data

(60) Provisional application No. 60/552,201, filed on Mar. 12, 2004.

(51) Int. Cl.
*B25B 13/18* (2006.01)
*B25B 13/12* (2006.01)
*B25B 13/22* (2006.01)

(52) U.S. Cl. ..... 81/128; 81/127; 81/129; 81/145

(58) Field of Classification Search ..... 81/128, 81/127, 126, 129, 129.5, 142, 145, 77
See application file for complete search history.

(56) References Cited

U.S. PATENT DOCUMENTS 3,817,128 A * 6/1974 Evans ..... 81/145
4,151,763 A * 5/1979 Colvin ..... 81/77
4,325,275 A 4/1982 Colvin
5,152,198 A * 10/1992 Schmitz, Jr. ..... 81/145
5,239,898 A * 8/1993 Douglas ..... 81/165
5,331,868 A * 7/1994 Elmore ..... 81/165
5,682,802 A * 11/1997 Mazzone ..... 81/127
5,809,852 A 9/1998 Haskell
6,076,434 A * 6/2000 Boukis ..... 81/165
6,223,631 B1 * 5/2001 Osa ..... 81/157
6,931,969 B1 * 8/2005 Hsien ..... 81/467
6,973,857 B1 * 12/2005 Anderson ..... 81/129

FOREIGN PATENT DOCUMENTS

CA 1240181 8/1988
GB 2196888 5/1988

* cited by examiner

*Primary Examiner*—Lee D. Wilson
*Assistant Examiner*—Alvin J. Grant
(74) *Attorney, Agent, or Firm*—R. Craig Armstrong; Borden Ladner Gervais LLP

(57) ABSTRACT

The adjustable wrench has two wrench elements each having a jaw portion and a body portion, each body portion having angled tongues and grooves, slideably mounted opposite one another with the jaw portions opposing each other. Between the two body portions is an actuator having two sides. Each side has angled tongues and grooves corresponding to and slideably engaging the angled tongues and grooves of each of the body portions. The actuator moves along a longitudinal axis of the handle thereby urging the wrench elements and jaws towards and away from one another depending on the direction of movement of the actuator, by interaction of the inclined grooves, acting as wedges using the inclined plane principle.

16 Claims, 11 Drawing Sheets

ADJUSTABLE WRENCH

REFERENCE TO RELATED APPLICATION

This application is a formal application based on and claiming the benefit of provisional application No. 60/552,201, filed Mar. 12, 2004.

BACKGROUND OF THE INVENTION

The invention relates generally to hand tools. More particularly, the invention relates to adjustable wrenches.

A common adjustable wrench in the prior art has a static jaw and a movable jaw on a screw thread. Rotating the screw slides the movable jaw across the wrench, allowing a user to adjust the space between the jaws to the required size bolt for tightening or loosening.

SUMMARY OF THE INVENTION

It is an object of the invention to provide an improved adjustable wrench.

In a first aspect, the invention provides an adjustable wrench having two wrench elements each having a jaw portion and a body portion, each body portion having angled grooves, slideably mounted opposite one another with the jaw portions opposing each other. Between the two body portions is an actuator having two sides. Each side has angled grooves corresponding to and slideably engaging the angled grooves of each of the body portions. The actuator moves along a longitudinal axis of the handle thereby urging the wrench elements transversely across the cavity of the handle, and thereby moving the jaws towards and away from one another depending on the direction of movement of the actuator, by interaction of the inclined grooves, acting as wedges using the inclined plane principle.

In a further embodiment, the wrench has a similar mechanism provided at the other end of the wrench, preferably but not necessarily connected to the same actuator such that when the actuator is moved, the jaws at both ends move. The jaws at one end preferably cover a different range of sizes from the range of sizes available at the other end.

Other aspects and features of the invention will become apparent to those ordinarily skilled in the art upon review of the following description of specific embodiments of the invention, in conjunction with the accompanying figures.

BRIEF DESCRIPTION OF THE DRAWINGS

Embodiments of the invention will now be described, by way of example only, with reference to the accompanying drawings, wherein.

DETAILED DESCRIPTION

Figure 1:
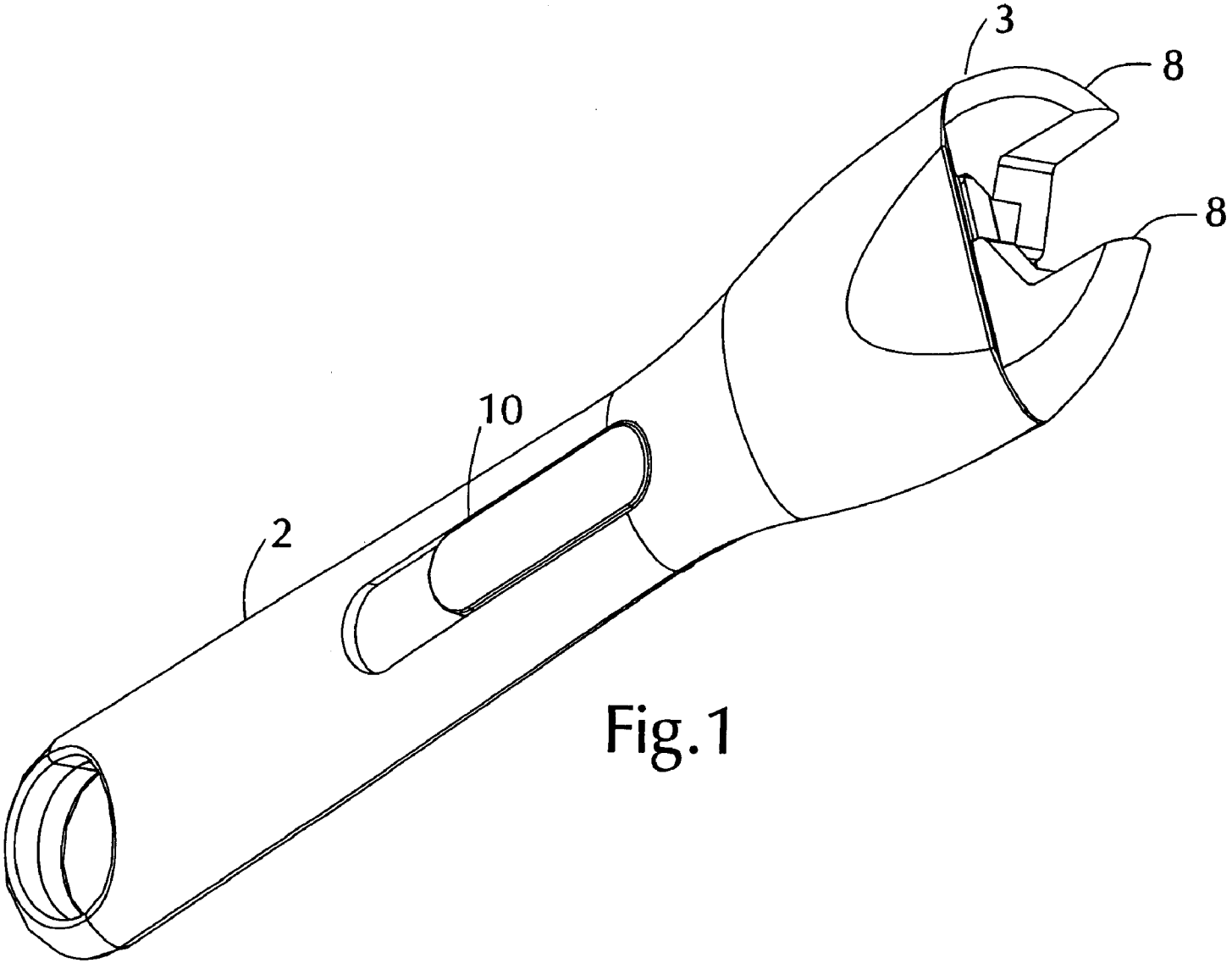
FIG. 1 is an isometric view of the wrench with the jaws in the open position.
Figure 2:
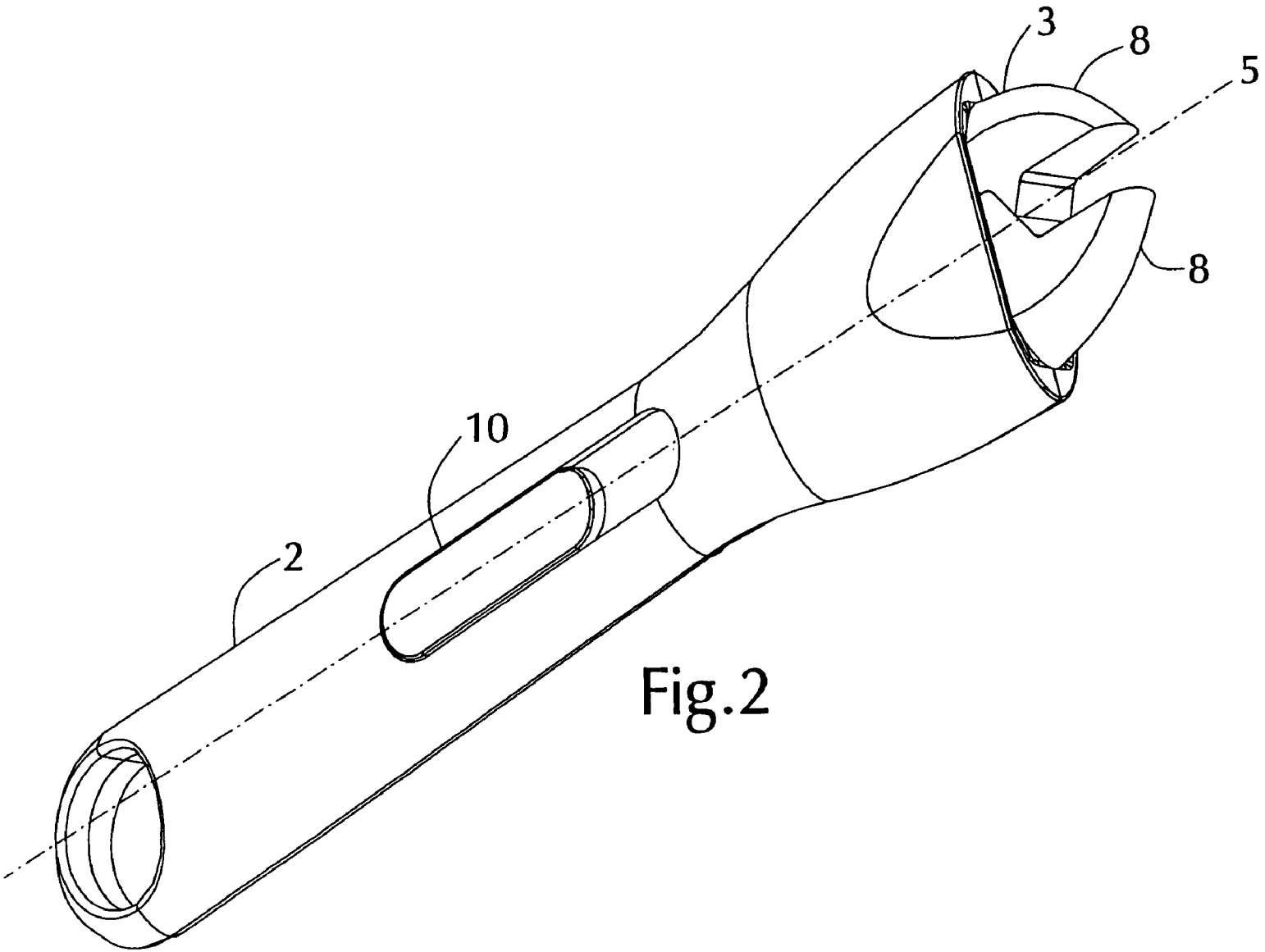
FIG. 2 is an isometric view of the wrench with the jaws in the closed position.

FIG. 1 is an isometric view of the wrench with the jaws in the open position. FIG. 2 shows the wrench in a similar view with the jaws in the closed position. The wrench has a handle 2 in two pieces 4, 6, two wrench elements 3 having jaw portions 8 that protrude from the handle 2, and a slideable button 10 on the handle that opens or closes the jaws 8 when the button is slid up or down the handle.

Figure 3:
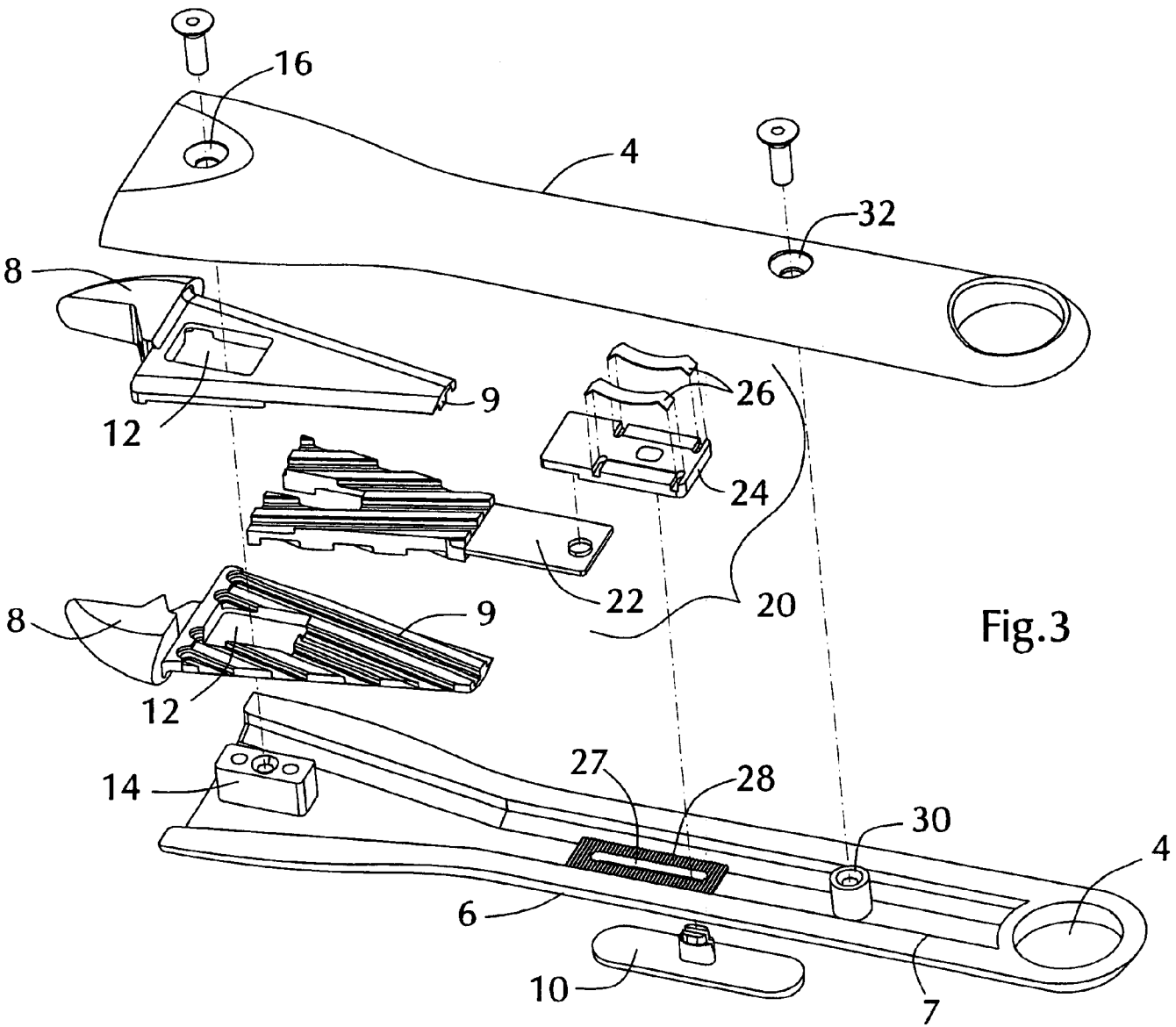
FIG. 3 is an exploded view of the wrench.
Figure 4:
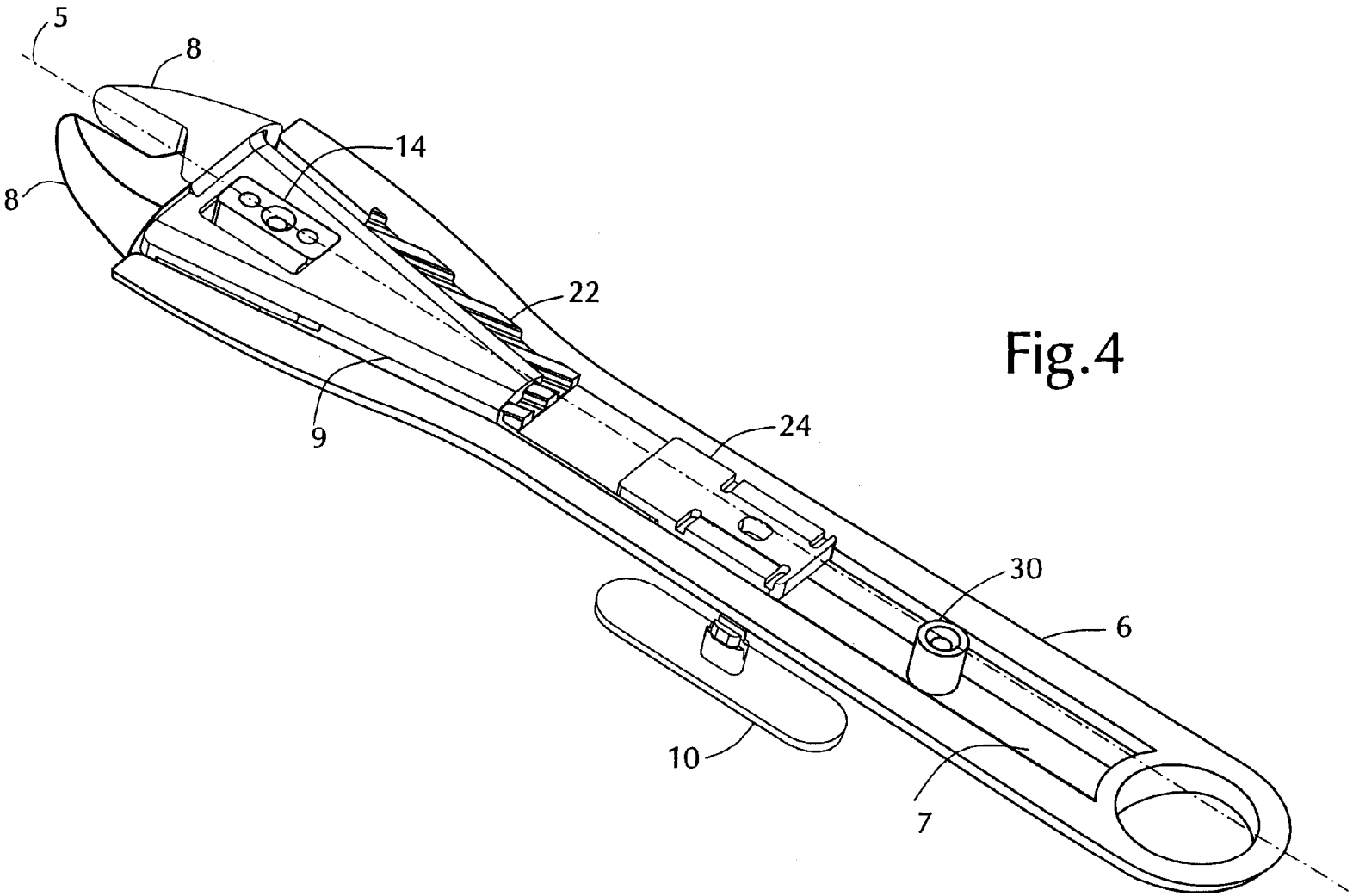
FIG. 4 is an isometric view of one side of the wrench without a first handle piece with the jaws in the closed position.

FIG. 3 is an exploded view of the wrench. A cavity 7 between the handle pieces 4, 6 holds body portions 9 of the wrench elements 3. The surface of each body portion has angled grooves, on an angle from the longitudinal axis 5 of the wrench. Each body portion 9 is smaller in width than the width of the cavity 7 and has an oblong hole 12. The oblong hole 12 is engaged by a protrusion 14 in a first handle piece 4 such that body portion 9 may slide along width of the handle 2, but is restricted in movement along the longitudinal axis 5 of the handle. The protrusion 14 has a threaded hole which aligns with a hole 16 in the second handle piece 6, to receive a bolt or screw (not shown) to secure the handle pieces together. Another protrusion 30 and hole 32 for a fastener (not shown) may be provided in the handle pieces to add stability to the wrench when assembled. The protrusions 14, 30 may be on the second handle piece 6 and the corresponding hole 16, 32 may be on the first handle piece 4, alternatively. Any other suitable means may be used to secure the handles pieces to each other, or to assist. For example, the edges of the handles may have complementary dovetailing or the like, so that one handle piece slides on the other, the fastener(s) then merely preventing sliding the handle pieces apart.

The body portions 9 of the wrench elements 3 are positioned in the handle cavity 7 in reverse to one another, such that the inclined surfaces of the body portions face one another and the jaws 8 are reversed. Preferably, for ease and economy of manufacturing, the wrench elements are identical to each other.

Figure 5:
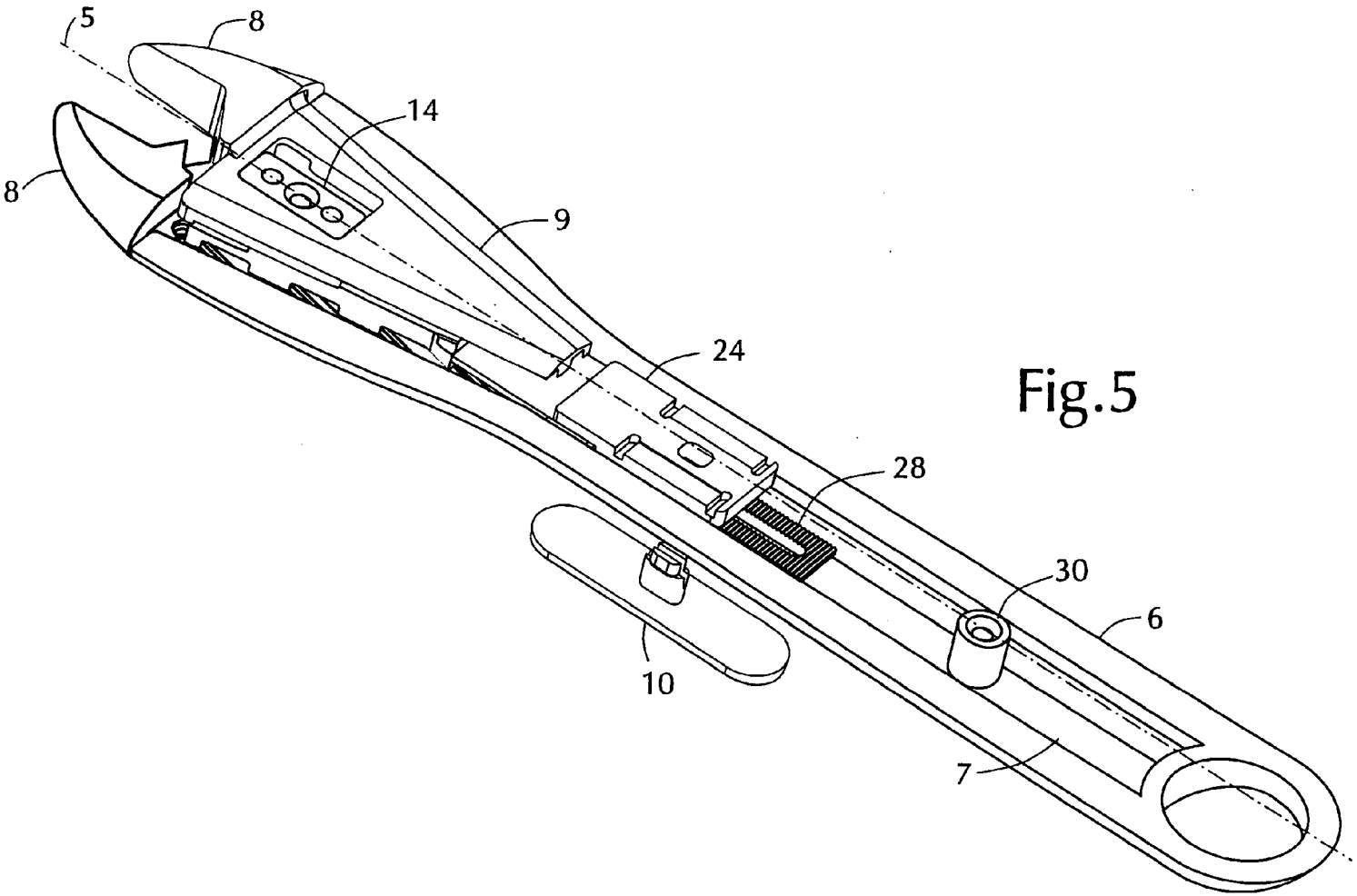
FIG. 5 is an isometric view of one side of the wrench without a first handle piece with the jaws in the open position.
Figure 6:
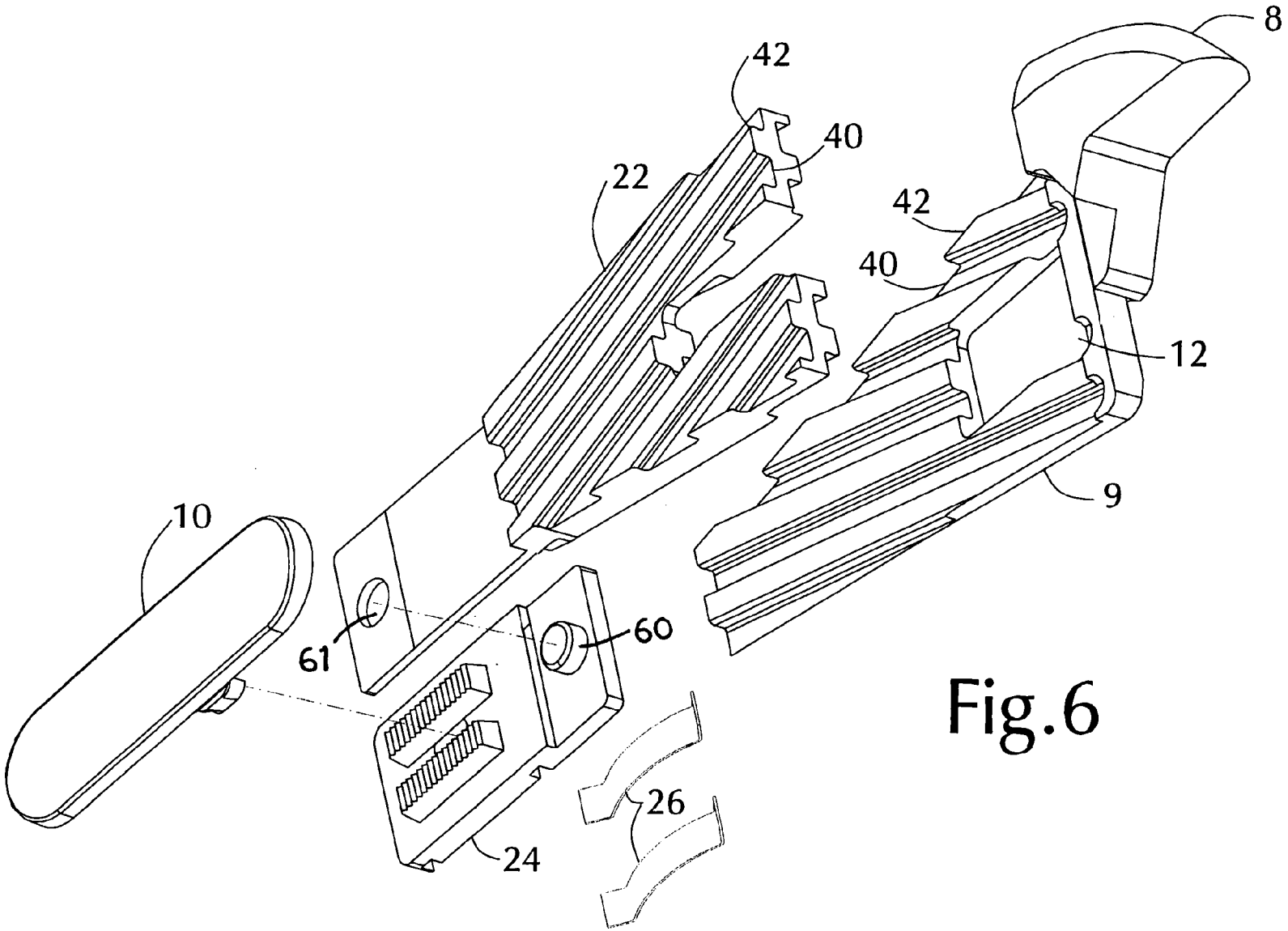
FIG. 6 is an exploded view of an actuator, a button and a wrench element.
Figure 7:
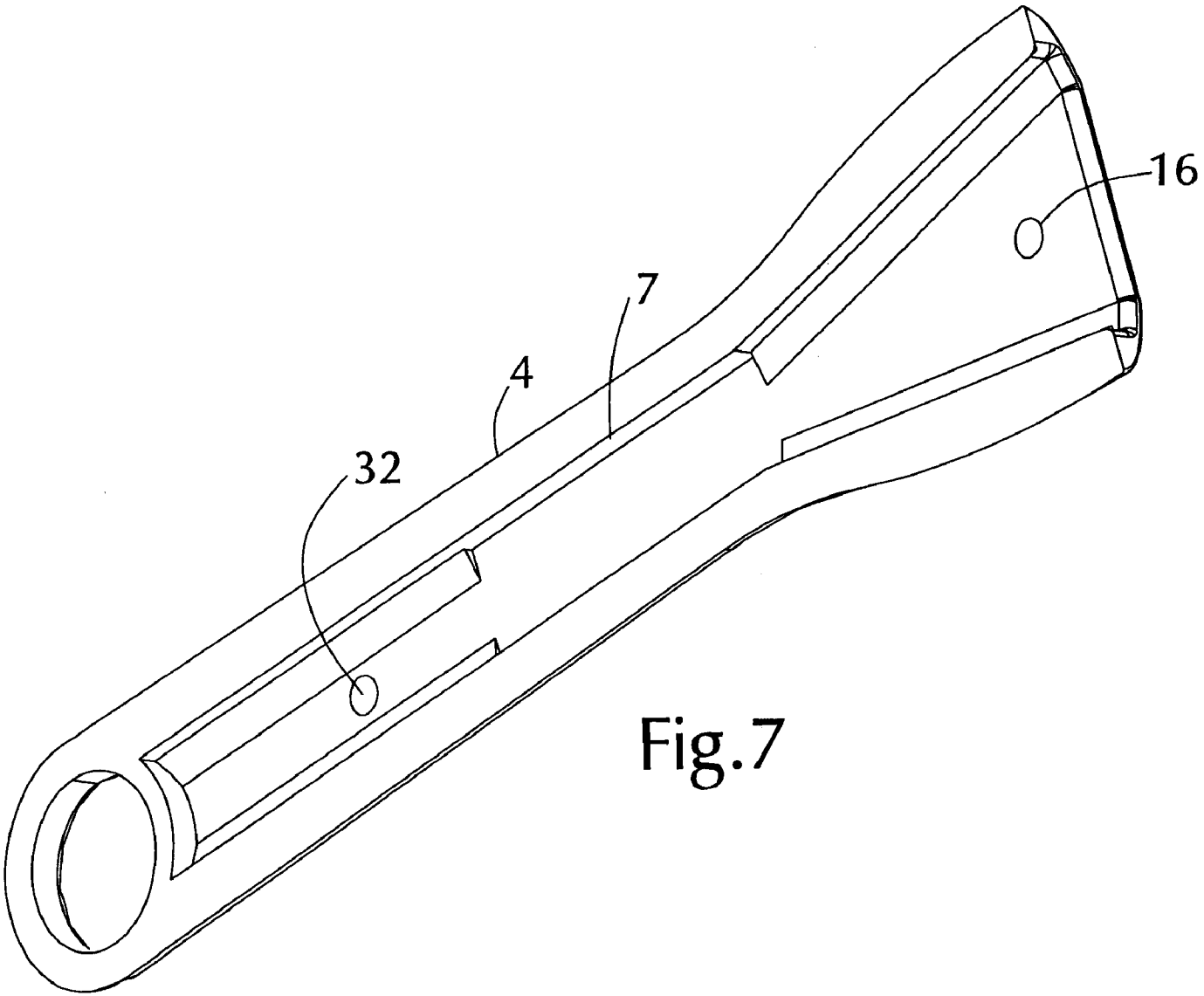
FIG. 7 is an isometric view of the first handle piece.
Figure 8:
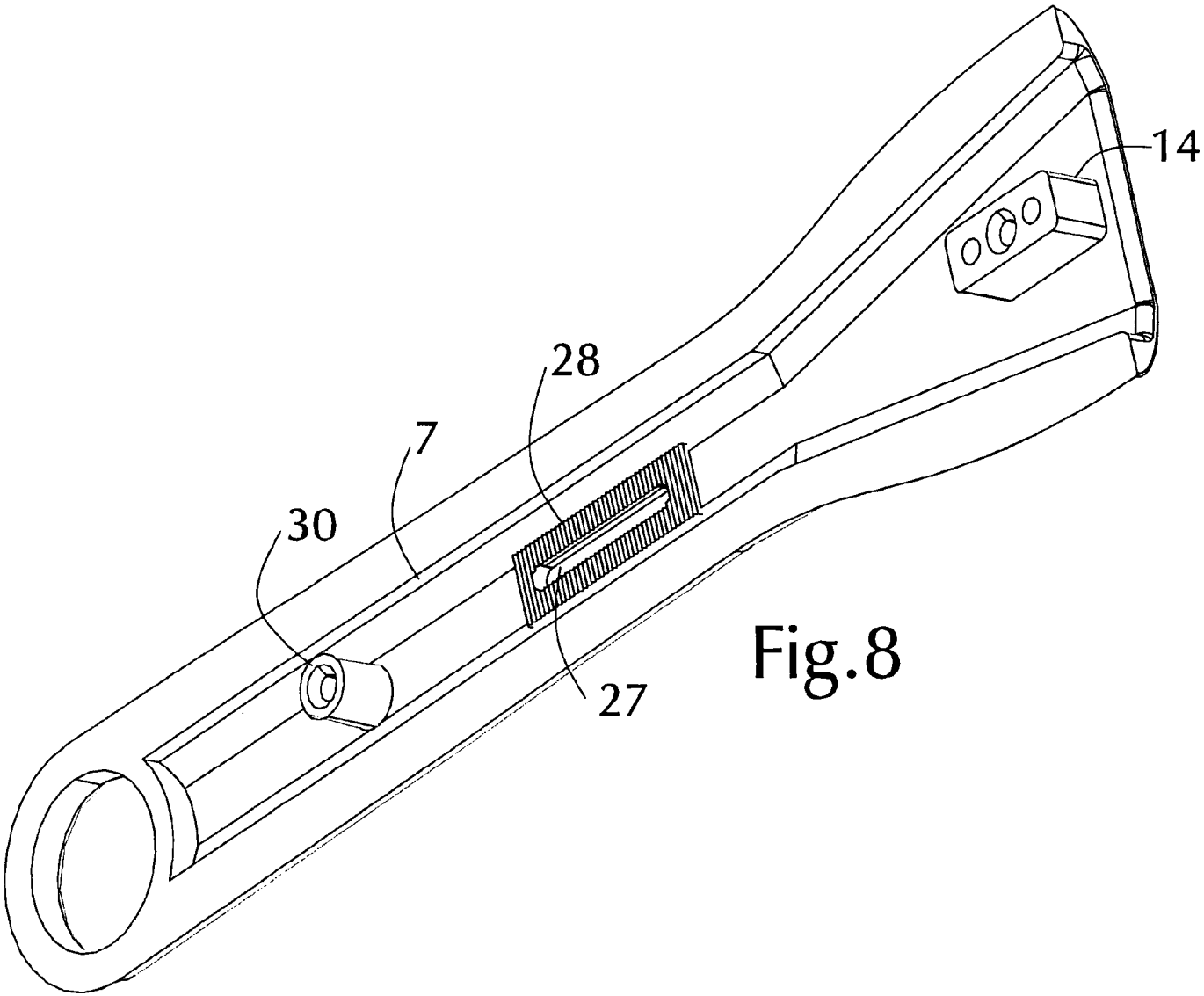
FIG. 8 is an isometric view of the second handle piece.
Figure 12:
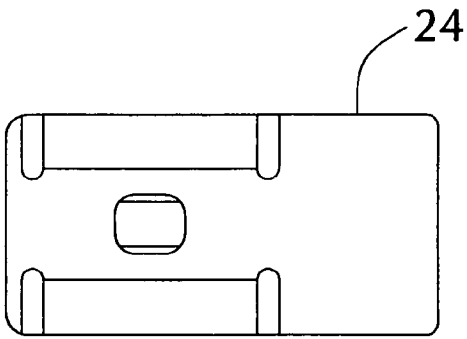
FIG. 12 is a view of the spring side of the slider.

Between the body portions is an actuator 20. The actuator 20 conveniently may be assembled from two pieces, namely an actuator plate 22 and a slider 24, rather than being in one piece. The actuator plate 22 has inclined grooves on each of its sides, which correspond to and engage the inclined grooves of the body portions 9. Preferably, it is identical on each side (i.e. FIG. 10 would appear the same regardless of which side of the actuator was being viewed). The actuator plate is connected to the slider 24, for example by a post 60 engaging a hole 61 in the actuator plate (see FIG. 6). The slider 24 has strips of teeth 34 to engage a series of stops 28 in the cavity 7 of the second handle piece 6, shown in FIG. 5 and FIG. 8, fixing the slider 24 and thereby the actuator plate 22 in positions along the longitudinal axis 5 of the handle. The slider 24 is held to the stops in the second handle by at least one biasing spring 26. The biasing spring fits into the slider on the opposite side of the strips of teeth 34 shown in FIG. 12. The slider 24 is engaged by the button 10 on the outside of the second handle piece 6 through an elongated slot 27 in the second handle piece 6. While the button 10 moves along the longitudinal axis 5 of the handle in the slot 27, the slider 24 similarly moves along the cavity 7 of the handle. As the slider moves, the teeth 34 engage the stops 28 as it moves. Pressing the button 10 down into the handle releases the slider 24 from the stop and allows the slider 24 to move. The slider 24, being connected to the actuator plate 22, pushes or pulls the actuator plate 22 along the cavity 7. As the actuator plate 22 moves along the longitudinal axis 5 of the handle, the inclined surfaces of the plate 22 engage the respective corresponding inclined surfaces of the body portions 9. The wedge-like movement of the actuator plate 22 against the body portions 9 causes the wrench elements 3 to be urged together or apart depending on the direction of movement of the plate 22. Because the wrench elements 3 are restricted in their movements in the direction of the longitudinal axis 5 of the handle, the wrench elements only move in the direction perpendicular to this axis 5.

Figure 9A:
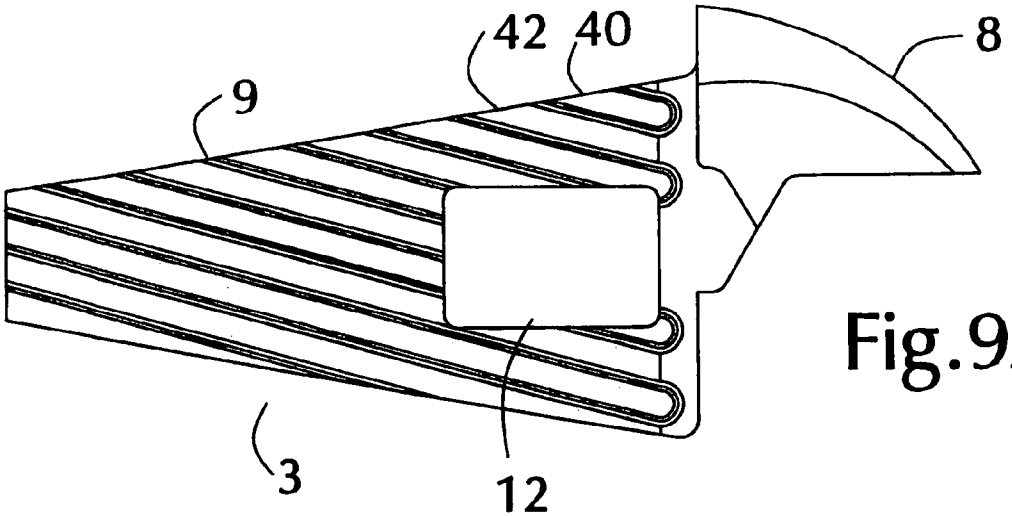
FIG. 9A is a view of one side of a wrench element.
Figure 9B:
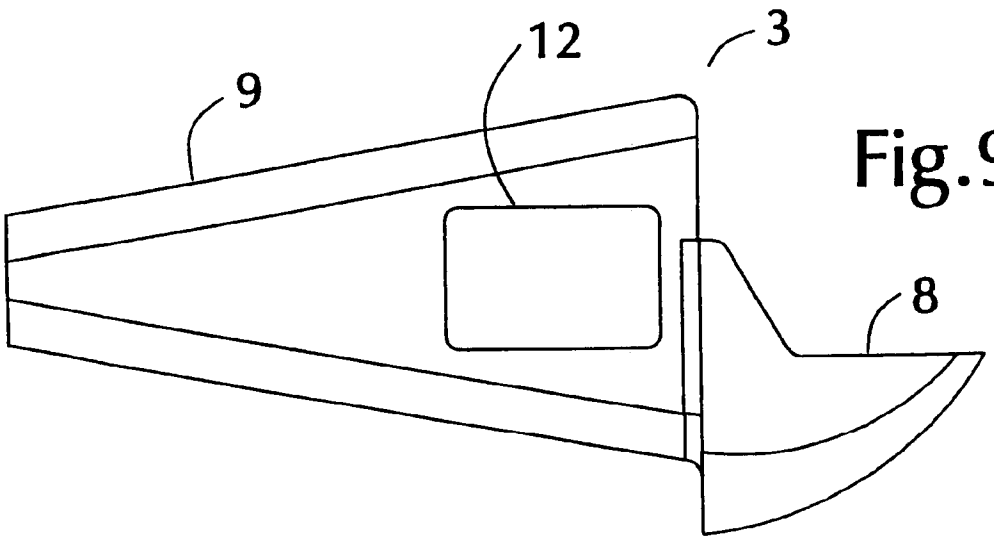
FIG. 9B is a view of the other side of a wrench element.
Figure 11:
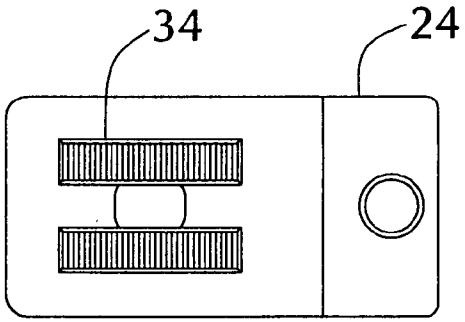
FIG. 11 is a view of engaging side of the slider.
Figure 10:
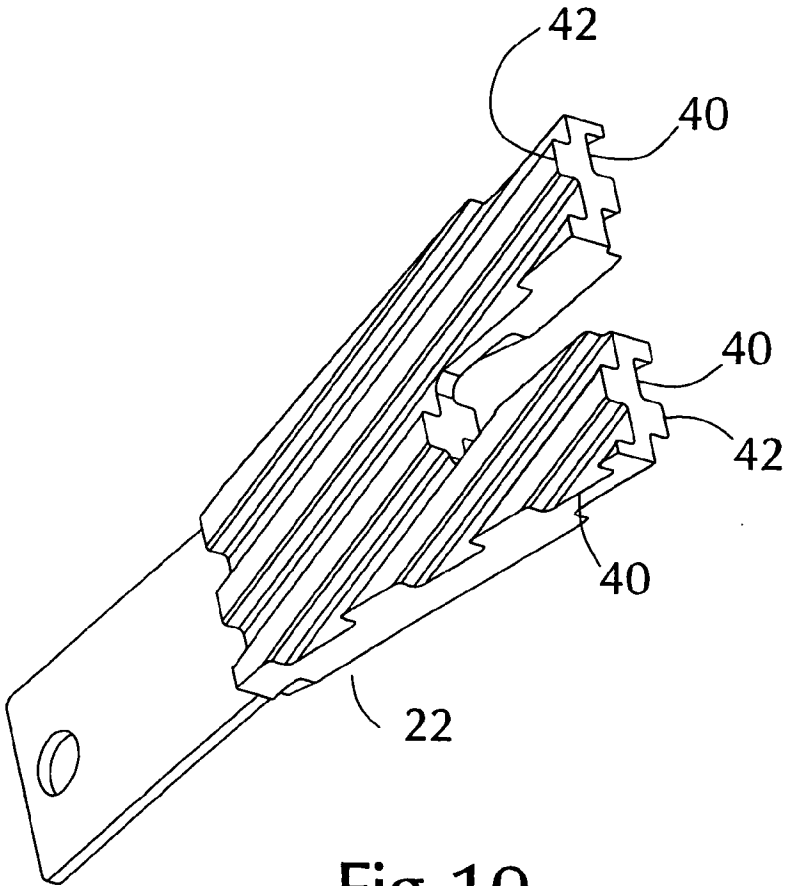
FIG. 10 is an isometric view of the actuator plate.

In the preferred embodiment, the inclined surfaces of the body portions 9 and the actuator plate 22 have a plurality of angled grooves 40 and corresponding angled tongues 42 as seen in FIGS. 9 and 10. The angled tongues 42 slideably fit in the angled grooves 40. An alternative to this may be a single angled groove and a corresponding projection in the respective surfaces (not shown).

In the preferred embodiment, the grooves are angled from the axis 5 at an angle of substantially less than 45 degrees, for example approximately 10–12 degrees in the preferred embodiment. Obviously this angle can be varied as desired. However, such a relatively small angle has several advantages. The main advantage is that it is easy to move the slider due to the mechanical advantage which results. Conversely, it is difficult to dislodge the jaws from any given position for the same reason, i.e. the jaws in effect are locked in any position they are set to. The teeth 34 which lock the slider in place thus to not bear any significant load; the load is born by the grooves. Thus it should be noted that, depending on the angle and the maximum torque intended to be applied by the wrench, the teeth may not be strictly necessary; they merely provide a convenient means of setting the jaws to a desired spacing. Thus the slider may have an arrow or other such marking, and the handle may corresponding markings to indicate different jaw spacings (metric, English units, or both).

In another alternative embodiment (not shown), the same mechanism is provided at the other end of the handle and preferably but not necessarily is connected to the same actuator and button, such that when the button is moved, at one end of the handle the jaws are opening, while at the other end, the jaws are also moving (closing or opening, depending on which direction the grooves are angled away from the tool axis.

Figure 13:
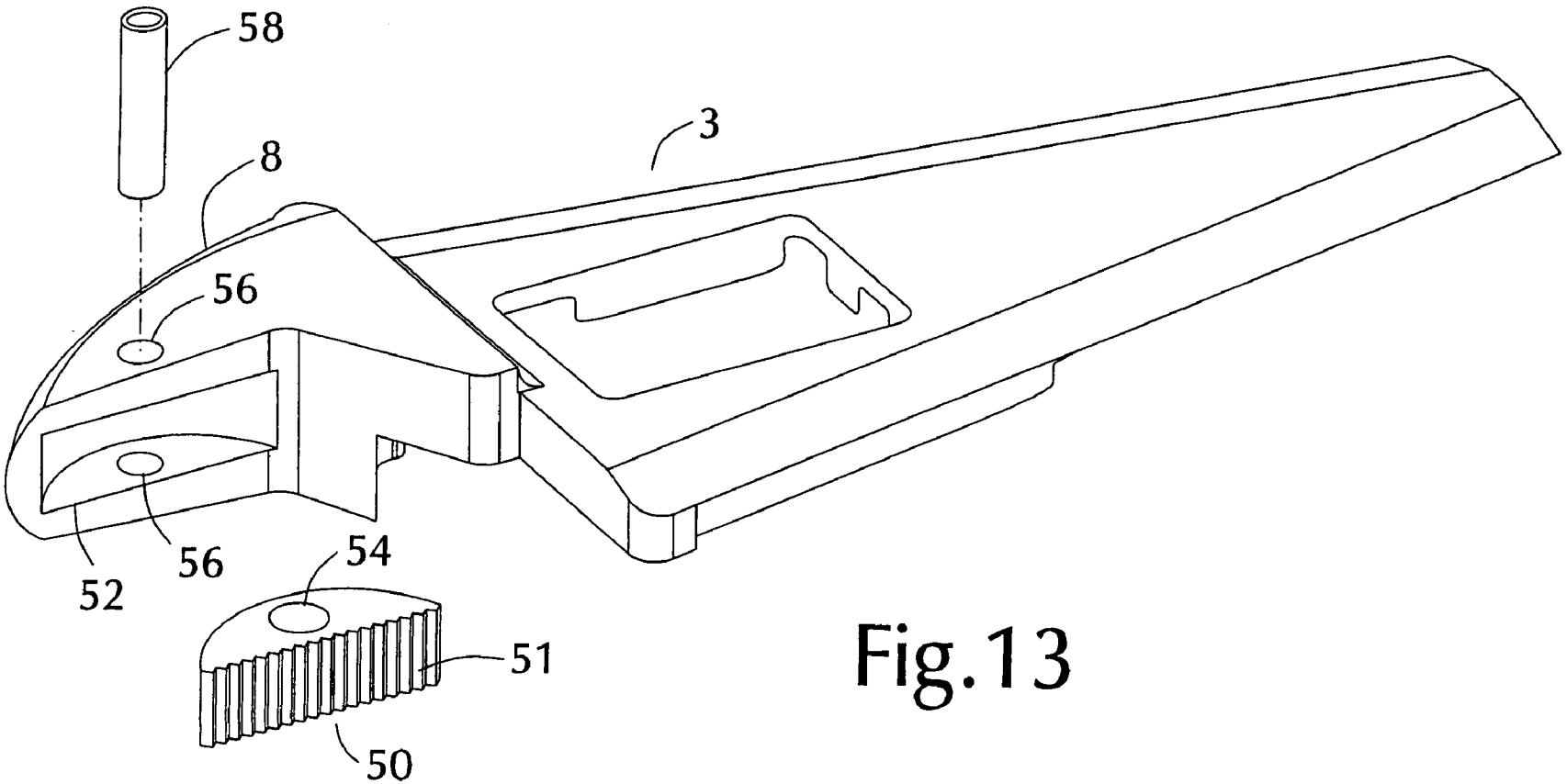
FIG. 13 is an isometric view of the wrench element with a gripping jaw body portion.

In a further alternative, shown in FIG. 13, the wrench element 3 is provided with a removable pivotable gripping jaw body portion 50. The surface 51 of the jaw body portion is corrugated to provide better gripping. The wrench element has a hollow opening 52 in the jaw portion 8 which the gripping jaw 50 is nested, and the gripping surface 51 protrudes from the opening. The gripping jaw is pivotably held in the opening by a pin 58 through corresponding holes 54, 56 in the gripping jaw and the wrench element. The gripping jaw 50 is able to pivot since the gripping jaw hole 54 is larger in diameter than the pin 58 going through it. This pivoting action allows the gripping jaw 50 to tighten on the flats of bolt heads.

The above-described embodiments of the invention are intended to be examples only. Alterations, modifications and variations may be effected to the particular embodiments by those of skill in the art without departing from the scope of the invention, which is defined solely by the claims appended hereto.

The invention claimed is:

1. An adjustable wrench comprising:

two wrench elements each having a jaw portion and a body portion, the body portions having inner surfaces with inclined tongues and grooves opposing one another;

an actuator between said body portions, said actuator having a plate with two sides, each side having a surface with inclined tongues and grooves corresponding to and slideably engaging said tongues and grooves of said body portions, said actuator moving along a longitudinal axis of said tool, thereby urging said wrench elements laterally and moving said jaw portions towards or away from each other.

2. An adjustable wrench as in claim 1, wherein said wrench elements and actuator are mounted in a handle comprising two pieces and defining a cavity between said two pieces, said wrench elements and actuator being moveably carried in said cavity, said jaw portions extending from a distal opening of said handle, said actuator being accessible through an opening in said handle.

3. An adjustable wrench as in claim 2, further comprising an actuator button slidable along the outside of the handle, connected to said actuator through a slot in said handle.

4. An adjustable wrench as in claim 3, wherein said actuator button engages any one of a plurality of stops, for fixing said actuator in any one of a plurality of positions.

5. An adjustable wrench as in claim 1, wherein said wrench elements are identical to each other.

6. An adjustable wrench as in claim 2, wherein said wrench elements are identical to each other.

7. An adjustable wrench as in claim 3, wherein said wrench elements are identical to each other.

8. An adjustable wrench as in claim 4, wherein said wrench elements are identical to each other.

9. An adjustable wrench as in claim 1, wherein said tongues and grooves are angled from a longitudinal axis of the tool at an angle substantially less than 45 degrees.

10. An adjustable wrench as in claim 2, wherein said tongues and grooves are angled from a longitudinal axis of the tool at an angle substantially less than 45 degrees.

11. An adjustable wrench as in claim 3, wherein said tongues and grooves are angled from a longitudinal axis of the tool at an angle substantially less than 45 degrees.

12. An adjustable wrench as in claim 4, wherein said tongues and grooves are angled from a longitudinal axis of the tool at an angle substantially less than 45 degrees.

13. An adjustable wrench as in claim 5, wherein said tongues and grooves are angled from a longitudinal axis of the tool at an angle substantially less than 45 degrees.

14. An adjustable wrench as in claim 6, wherein said tongues and grooves are angled from a longitudinal axis of the tool at an angle substantially less than 45 degrees.

15. An adjustable wrench as in claim 7, wherein said tongues and grooves are angled from a longitudinal axis of the tool at an angle substantially less than 45 degrees.

16. An adjustable wrench as in claim 8, wherein said tongues and grooves are angled from a longitudinal axis of the tool at an angle substantially less than 45 degrees.

* * * * *